US009595795B2

(12) United States Patent
Lane et al.

(10) Patent No.: US 9,595,795 B2
(45) Date of Patent: Mar. 14, 2017

(54) HEADER ASSEMBLY

(71) Applicant: TYCO ELECTRONICS CORPORATION, Berwyn, PA (US)

(72) Inventors: David James Lane, Hummelstown, PA (US); Jesse Alan Baker, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/944,932

(22) Filed: Nov. 18, 2015

(65) Prior Publication Data

US 2016/0164232 A1 Jun. 9, 2016

Related U.S. Application Data

(60) Provisional application No. 62/089,612, filed on Dec. 9, 2014.

(51) Int. Cl.

| | |
|---|---|
| ***H01R 12/00*** | (2006.01) |
| ***H01R 24/38*** | (2011.01) |
| ***H01R 13/506*** | (2006.01) |
| ***H01R 13/645*** | (2006.01) |
| ***H01R 24/50*** | (2011.01) |
| *H01R 103/00* | (2006.01) |
| *H01R 13/627* | (2006.01) |

(Continued)

(52) U.S. Cl.

CPC ..... *H01R 24/38* (2013.01); *H01R 13/506* (2013.01); *H01R 13/6456* (2013.01); *H01R 24/50* (2013.01); *H01R 13/6272* (2013.01); *H01R 13/6583* (2013.01); *H01R 24/52* (2013.01); *H01R 2103/00* (2013.01); *H01R 2201/26* (2013.01)

(58) Field of Classification Search

CPC ..... H01R 2103/00; H01R 9/0515; H01R 23/7073; H01R 24/50; H01R 24/52

USPC ..... 439/63, 578

See application file for complete search history.

(56) References Cited

U.S. PATENT DOCUMENTS 4,111,514 A * 9/1978 Brishka ..... H01R 13/64 285/914

4,964,805 A * 10/1990 Gabany ..... H01R 24/50 439/434

(Continued)

FOREIGN PATENT DOCUMENTS

WO 2014/085147 A1 6/2014

OTHER PUBLICATIONS

International Search Report, International Application No. PCT/US2015/061881, International Filing Date, Nov. 20, 2015.

*Primary Examiner* — Abdullah Riyami
*Assistant Examiner* — Vladimir Imas

(57) ABSTRACT

A header assembly includes an outer housing holding a center contact and a dielectric body. The outer housing has a rear shell and an outer contact extending forward from the rear shell. The outer contact has a catch extending therefrom positioned forward of the rear shell. The header assembly includes a nose cone coupled to the outer contact. The nose cone surrounds the outer contact. The nose cone has one or more keying ribs along an exterior thereof. The nose cone has a latch engaging the catch to secure the nose cone to the outer housing in one of at least two distinct rotational orientations.

20 Claims, 6 Drawing Sheets

(51) Int. Cl.
*H01R 13/6583* (2011.01)
*H01R 24/52* (2011.01)

(56) References Cited

U.S. PATENT DOCUMENTS 6,152,743 A * 11/2000 Fox ..... H01R 24/42 439/620.03
6,824,403 B2 * 11/2004 Hall ..... H01R 24/50 439/101
7,029,286 B2 * 4/2006 Hall ..... H01R 13/506 439/357
7,101,189 B1 9/2006 Huss et al.
7,563,103 B1 * 7/2009 Hall ..... H01R 24/50 439/581
7,682,205 B2 * 3/2010 Hall ..... H01R 13/4361 439/752
7,794,277 B1 * 9/2010 Peng ..... H01R 24/42 439/607.01
8,298,005 B2 * 10/2012 Annequin ..... H01R 24/50 439/578
8,430,675 B2 * 4/2013 Hardy ..... H01R 12/724 439/607.36
8,740,629 B1 6/2014 Hall et al.
9,391,409 B2 * 7/2016 Abe ..... H01R 13/6582
2002/0142625 A1 * 10/2002 Berghorn ..... H01R 13/6315 439/63
2006/0172562 A1 * 8/2006 Weidner ..... H01R 24/50 439/63
2009/0137133 A1 * 5/2009 Gou ..... H01R 24/50 439/63
2009/0220013 A1 * 9/2009 Butts ..... H01R 13/6581 375/257
2014/0099822 A1 * 4/2014 Duesterhoeft ..... H01R 13/6583 439/607.02
2014/0148052 A1 * 5/2014 Hall ..... H01R 13/6456 439/607.01

* cited by examiner

HEADER ASSEMBLY

CROSS-REFERENCE TO RELATED APPLICATIONS

This application claims priority to U.S. Provisional Application No. 62/089,612, filed 9 Dec. 2014, which is incorporated by reference in its entirety.

BACKGROUND OF THE INVENTION

The subject matter herein relates generally to header assemblies.

Radio frequency (RF) coaxial connector assemblies have been used for numerous automotive applications, such as global positioning systems (GPS), car radios, mobile phones, air bag systems, and multimedia devices. Some coaxial connector assemblies are cable assemblies that are terminated to ends of coaxial cables. Coaxial cables typically consist of an outer conductor, an inner conductor, a dielectric, and a jacket or outer insulation. The outer conductor and the inner conductor of the cable electrically interface with corresponding inner and outer contacts of the connector, which may be a male or a female connector. Other coaxial connector assemblies are terminated to a circuit board rather than a cable. To interface with coaxial cable assemblies, such board-mounted assemblies include a coaxial interface defined by a center contact and an outer contact surrounding the center contact. Both the center and outer contacts terminate to the circuit board.

In order to standardize various types of connectors and thereby avoid confusion, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. The keying and color identifying features of a FAKRA connector are typically on a housing. Male keying features can only be connected to like female keyways in FAKRA connector assemblies. Secure positioning and locking of connector housings is facilitated by way of a FAKRA defined catch on the male housing and a cooperating latch on the female housing.

Typical product families of FAKRA connectors include numerous different male housings, each having a different mold or die or tool inserts to form the particular arrangement of keys. Manufacturing many different molds or dies is expensive. Additionally, requiring customers to carry a different part for each desired keying configuration causes additional expense to the customer in terms of inventory and warehousing of inventory. A need remains for a connector assembly that is part of a product family that reduces part numbers.

In addition, in some connector assemblies, the male housings are formed by releasably coupling an interface housing to a shell. The keying features are on the interface housing, and the shell terminates to the cable or circuit board. Multiple different interface housings may be formed that have different kinds and/or positions of keying features, and multiple different shells may be formed that couple to the interface housings at different rotational orientations. The interface housings are substitutable on the shells in order to mix and match the keying features and the orientations of the connector. In addition to being expensive and difficult to require multiple different parts for each desired keying configuration, the coupling between the interface housing and the shell in some known connector systems is inadequate to meet standard-defined retention requirements. For example, in some known connector systems, the interface housing is coupled to the shell by a single latch and catch. The retention between the latch and catch fails at forces below the retention requirement. Thus, pulling on a mating connector coupled to the male housing causes the latch to fail below the retention requirement threshold, resulting in the interface housing uncoupling from the shell. A need remains for a connector assembly that provides better retention between the interface housing and the shell.

BRIEF DESCRIPTION OF THE INVENTION

In an embodiment, a header assembly is provided that includes a center contact, a dielectric body, an outer housing, and a nose cone. The dielectric body surrounds the center contact. The outer housing holds the center contact and the dielectric body. The outer housing has a rear shell and an outer contact extending forward from the rear shell. The outer contact receives the center contact and the dielectric body. The outer contact has multiple locking tabs extending from an exterior thereof. The locking tabs are spaced apart at different angular positions around a perimeter of the outer contact. The nose cone is coupled to and surrounds the outer contact. The nose cone has one or more keying ribs along an exterior thereof. The nose cone has multiple latches spaced apart at different angular positions around a perimeter of the nose cone. The latches engage the locking tabs to secure the nose cone to the outer housing.

In another embodiment, a header assembly is provided that includes a center contact, a dielectric body, an outer housing, and a nose cone. The dielectric body surrounds the center contact. The outer housing holds the center contact and the dielectric body. The outer housing has a rear shell and an outer contact extending forward from the rear shell. The outer contact receives the center contact and the dielectric body. The outer contact has four locking tabs extending from an exterior thereof. The locking tabs are located at different angular positions 90 degrees from one another around a perimeter of the outer contact. The nose cone is coupled to the outer contact. The nose cone defines a cavity that receives the outer contact therein. The nose cone has one or more keying ribs along an exterior thereof. The nose cone has four latches spaced apart at different angular positions around a perimeter of the nose cone. Each of the latches engages one of the locking tabs to secure the nose cone to the outer housing in one of four distinct orthogonal rotational orientations.

In another embodiment, a header assembly is provided that includes a center contact, a dielectric body, an outer housing, and a nose cone. The dielectric body surrounds the center contact. The outer housing holds the center contact and the dielectric body. The outer housing has a rear shell and an outer contact extending forward from the rear shell. The outer contact receives the center contact and the dielectric body. The outer contact has multiple locking tabs extending from an exterior thereof. The locking tabs are spaced apart at different angular positions around a perimeter of the outer contact. The locking tabs define spaces between adjacent locking tabs. The nose cone is coupled to the outer contact. The nose cone defines a cavity that receives the outer contact therein. The nose cone has one or more keying ribs along an exterior thereof. The nose cone further has multiple latches spaced apart at different angular positions around a perimeter of the nose cone. The latches engage the locking tabs to couple the nose cone to the outer contact. The nose cone includes alignment lugs extending into the cavity from an interior surface of the nose cone. The alignment lugs are received in the spaces between the locking tabs when the nose cone is coupled to the outer contact to orient the nose cone relative to the outer housing in one of multiple distinct rotational orientations.

DETAILED DESCRIPTION OF THE INVENTION

Figure 1:
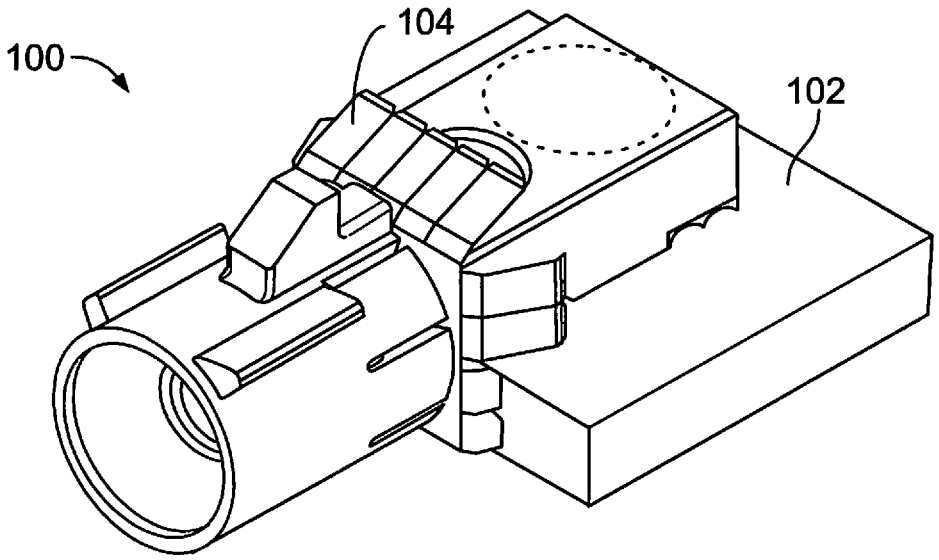
FIG. 1 is a front perspective view of a header assembly formed in accordance with an exemplary embodiment.

FIG. 1 is a front perspective view of a header assembly 100 formed in accordance with an exemplary embodiment. The header assembly 100 may be mounted in a device, such as a radio, having a casing that houses components of a communication system. The header assembly 100 may pass through an opening in the casing of the device for mating with a corresponding connector assembly (not shown).

The header assembly 100 is mounted to a circuit board 102, which may form part of a communication system, such as for an automotive vehicle. For example, the communication system may be used in an automotive application, such as a global positioning system (GPS), car radio, mobile phone, rear-view camera, air bag system, multimedia device system, and the like. The system may have use in other types of applications such as aeronautic applications, marine applications, military applications, industrial applications and the like. The circuit board 102 may form part of an antenna. The circuit board 102 may form part of a radio frequency (RF) system.

In the illustrated embodiment, the header assembly 100 constitutes a male assembly that is configured to be mated with a corresponding female assembly (not shown). In an exemplary embodiment, the header assembly 100 is a standardized connector, such as a FAKRA standardized connector. The header assembly 100 has features designed according to desired FAKRA specifications. For example, the header assembly 100 may have certain keying configurations.

In an embodiment, the header assembly 100 is part of a product family of FAKRA connectors. The product family includes many different keying configurations. The design of the header assembly 100 reduces the number of parts needed to complete the product family. For example, the header assembly 100 allows components to be mixed and matched and coupled together in different ways to achieve different keying combinations without the need for one particular part for each keying configuration. The overall cost of manufacturing the product family is reduced by the robust design of the header assembly 100. The total parts needed on hand is reduced with the header assembly 100.

Optionally, the header assembly 100 includes a shield member 104 attached thereto. The shield member 104 may be used to provide shielding at the opening through the casing of the device. The shield member 104 is used to electrically connect the header assembly 100 to the casing of the device. For example, the shield member 104 may create a direct electrical path between the casing and the header assembly 100.

Figure 2:
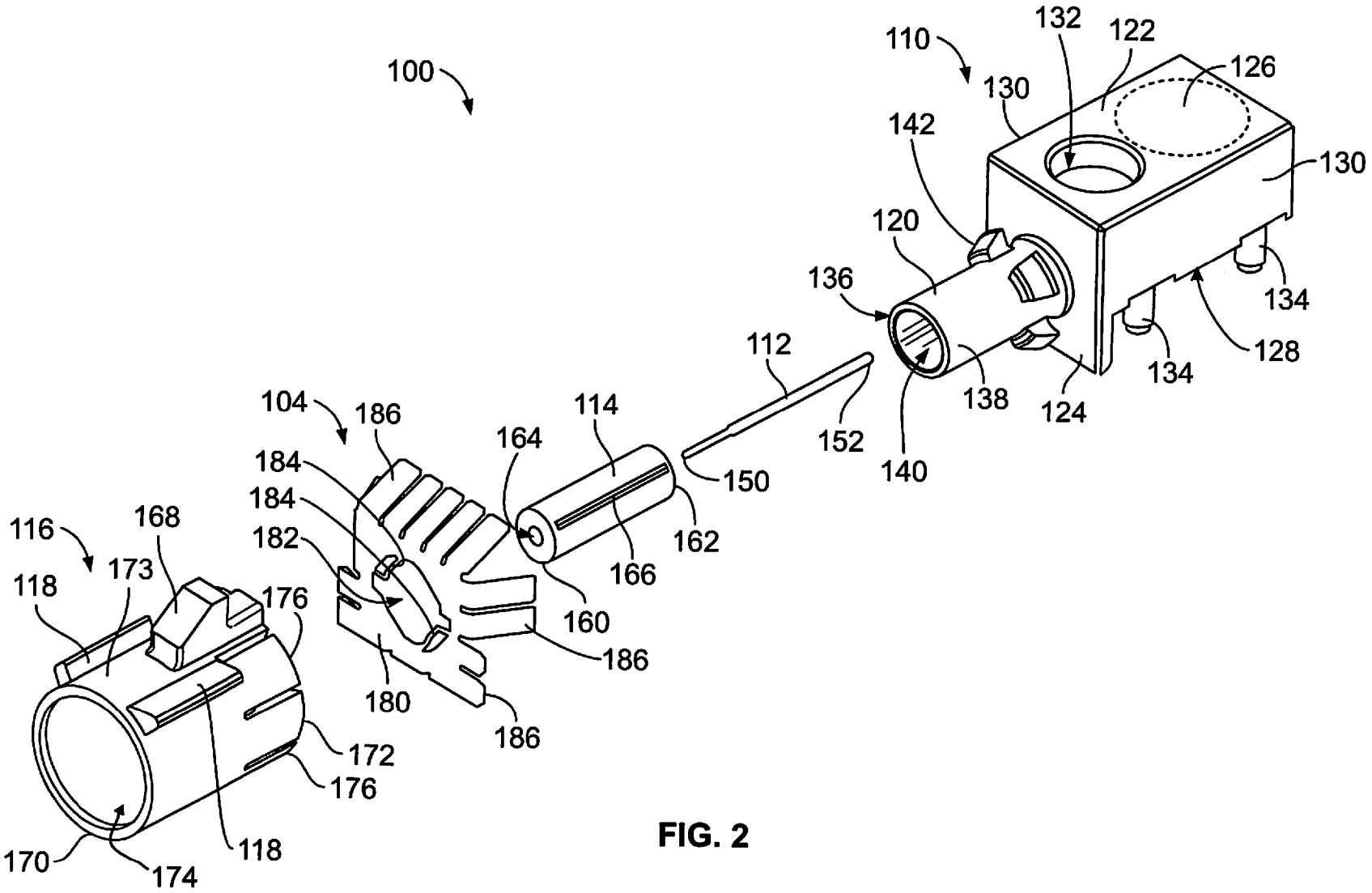
FIG. 2 is an exploded perspective view of the header assembly.

FIG. 2 is an exploded perspective view of the header assembly 100. The header assembly 100 includes an outer housing 110, a center contact 112, a dielectric body 114, the optional shield member 104, and a nose cone 116. The center contact 112 and dielectric body 114 are received in the outer housing 110. The shield member 104 couples to the outer housing 110. The nose cone 116 couples to a front of the outer housing 110. The nose cone 116 defines a mating interface for accommodating and engaging a mating connector (not shown). The exploded view of the components of the header assembly 100 in FIG. 2 is meant to illustrate the components, and not to describe how the header assembly 100 is assembled. For example, although the center contact 112 and dielectric body 114 are illustrated in front of the outer housing 110 in FIG. 2, the center contact and dielectric body 114 may be received in the outer housing 110 from behind or underneath the outer housing 110 during the assembly process.

In an exemplary embodiment, the mating interface of the header assembly 100 defines a FAKRA compliant connector. The nose cone 116 provides an interface keyed according to FAKRA specifications. For example, the nose cone 116 includes one or more keying ribs 118 on an exterior surface thereof. The nose cone 116 may have color identification. The size, shape and/orientation of the one or more keying ribs 118 may be used to define the different FAKRA interfaces. The nose cone 116 in the illustrated embodiment includes two keying ribs 118. Optionally, different nose cones 116 that have different arrangements of keying ribs 118 may be provided within the same product family. The different nose cones 116 may be coupled to the outer housing 110 to define different keying configurations. In an exemplary embodiment, as described in further detail below, each nose cone 116 may be coupled to the outer housing 110 in different rotational orientations relative to the outer housing 110 to define different keying configurations. For example, in one rotational orientation, the keying ribs 118 may be provided on a top of the header assembly 100, but in another orientation, the nose cone 116 may be rotated 180° such that the keying ribs 118 are provided on the bottom of the header assembly 100. In alternative embodiments, the header assembly 100 may be designed to different standards and/or to mate with different types of mating connectors.

The outer housing 110 has an outer contact 120 and a rear shell 122. The outer housing 110 is manufactured from a conductive material, such as a metal material. In an exemplary embodiment, the outer housing 110 is die cast, however the outer housing 110 may be manufactured by other processes in alternative embodiments, such as by stamping and forming. The outer housing 110 is configured to be electrically grounded to an electrical device, such as the circuit board 102 (shown in FIG. 1), the mating connector (not shown), or the casing of the device (described above) via the shield member 104. Alternatively, a positive or negative signal may be conveyed through the outer housing 110. The outer housing 110 provides electrical shielding for the center contact 112 along an entire length of the center contact 112.

The rear shell 122 is generally box-shaped, and includes a front wall 124. The rear shell 122 further includes a top wall 126 and two side walls 130 extending rearward from the front wall 124. Opposite to the top wall 126 is an open bottom 128. As used herein, relative or spatial terms such as "top," "bottom," "front," "rear," "left," and "right" are only used to distinguish the referenced elements and do not necessarily require particular positions or orientations in the header assembly 100 or in the surrounding environment of the header assembly 100. The rear shell 122 may be other than box-shaped in alternative embodiments. The walls 124, 126, 130 of the rear shell 122 define a receptacle 132 that receives the center contact 112. The rear shell 122 provides electrical shielding around the center contact 112. The center contact 112 extends into the receptacle 132 of the rear shell 122 and is exposed along the open bottom 128 for termination to the circuit board 102 (shown in FIG. 1). The open bottom 128 of the rear shell 122 may be mounted directly to the circuit board 102. For example, the center contact 112 may be surface mounted to the circuit board 102, such as by soldering to the circuit board 102.

The rear shell 122 includes mounting posts 134 extending from the bottom 128. The mounting posts 134 may be loaded into corresponding openings in the circuit board 102 (shown in FIG. 1) to locate the outer housing 110 relative to the circuit board 102. The mounting posts 134 may be electrically connected to the circuit board 102. For example, the openings in the circuit board 102 may be plated and the mounting posts 134 may be soldered therein. Other types of features may be provided in alternative embodiments to locate and/or secure the outer housing 110 to the circuit board.

In the illustrated embodiment, the header assembly 100 is a right angle header assembly, such that the mating connector mates to the header assembly 100 in a direction that is parallel to a top surface of the circuit board 102 (shown in FIG. 1). Mating occurs at the front of the outer housing 110, which is generally perpendicular to the open bottom 128 that mounts to the circuit board 102. In an alternative embodiment, the header assembly may be a vertical or in-line header assembly having a bottom that is opposite to the mating end. The center contact may extend perpendicular to the top surface of the circuit board in a vertical direction and may be terminated by a press fit. In other alternative embodiments, the header assembly may be cable-mounted rather than being mounted to the circuit board.

The outer contact 120 extends forward from the front wall 124 of the rear shell 122. Optionally, the outer contact 120 may be cylindrical in shape. The outer contact 120 includes a bore 140 that extends therethrough from a distal end 136 of the outer contact 120 to the receptacle 132 of the rear shell 122. The center contact 112 and the dielectric body 114 are held in the bore 140 of the outer contact 120. The outer contact 120 surrounds the center contact 112 to provide electrical shielding for the center contact 112. The dielectric body 114 surrounds the center contact 112 within the bore 140 to provide electrical isolation between the center contact 112 and the outer contact 120.

In an exemplary embodiment, the outer contact 120 includes multiple locking tabs 142 proximate to the front wall 124 of the rear shell 122. The locking tabs 142 extend outward from an exterior surface 138 of the outer contact 120. The locking tabs 142 are spaced apart at different angular positions around or along a perimeter of the outer contact 120. The locking tabs 142 are used to secure and orient the nose cone 116 on the outer housing 110. For example, the locking tabs 142 act as catches that engage the nose cone 116. The multiple locking tabs 142 allow the nose cone 116 to be variably positionable on the outer contact 120 to allow for multiple different rotational orientations of the nose cone 116, so each nose cone 116 may be used to provide multiple different keying configurations. Once the nose cone 116 is coupled to the outer contact 120, the locking tabs 142 may also be used to restrict rotation of the nose cone 116 relative to the outer housing 110.

The center contact 112 extends between a mating end 150 and a terminating end 152. In the illustrated embodiment, the mating end 150 constitutes a pin, however other types of mating interfaces may be provided in alternative embodiments. For example, the mating end 150 may be a socket, a blade, a deflectable spring beam, or another type of mating interface. The terminating end 152 is configured to be terminated to the circuit board 102 (shown in FIG. 1). Optionally, the terminating end 152 may be surface mounted to the circuit board 102, such as by using a solder ball, a deflectable spring or another type of interface. In an alternative embodiment, the terminating end 152 may include a straight pin or a compliant pin, such as an eye-of-the-needle pin, for through-hole mounting to a corresponding via of the circuit board 102. The center contact 112 is formed of a conductive material, such as a metal material. The center contact 112 may be manufactured by a stamping and forming process.

The dielectric body 114 extends between a front 160 and a rear 162. In an embodiment, the dielectric body 114 is cylindrical in shape. The dielectric body 114 includes a channel 164 extending between the front 160 and the rear 162. The channel 164 receives the center contact 112 therein. The dielectric body 114 is manufactured from a non-conductive material, such as a plastic material. The dielectric body 114 may be manufactured by an injection molding process or another molding process. Alternatively, the dielectric body 114 may be machined (for example, by cutting, grinding, boring, etc.), 3D printed, or the like. In an embodiment, the dielectric body 114 includes one or more ribs 166 extending longitudinally along an exterior surface of the dielectric body 114. The ribs 166 may be used to position the dielectric body 114 in the bore 140 of the outer contact 120. For example, the ribs 166 may provide an interference fit between the dielectric body 114 and the outer contact 120, and may prevent rotation of the dielectric body 114 within the outer contact 120.

The nose cone 116 is generally cylindrical in shape and extends between a front 170 and a rear 172. The one or more keying ribs 118 extend longitudinally along an exterior surface 173 of the nose cone 116. The nose cone 116 also includes a primary latch catch 168 along the exterior surface 173 that is used to secure the header assembly 100 to the mating connector. The primary latch catch 168 couples to a primary latch on the mating connector when the mating connector is mated to the header assembly 100. The nose cone 116 includes a cavity 174 extending between the front 170 and the rear 172. The nose cone 116 is configured to be loaded onto the front of the outer housing 110 over the outer contact 120, such that the outer contact 120 is received in the cavity 174 and is surrounded by the nose cone 116. The nose cone 116 in an embodiment is manufactured from a non-conductive material, such as a plastic material. The nose cone 116 may be manufactured by an injection molding process or another molding process. In an alternative embodiment, the nose cone 116 may be composed entirely or partially of a conductive material, such as a metal material. The nose cone 116 alternatively may be manufactured by machining, 3D printing, or the like.

The nose cone 116 includes multiple latches 176 used to secure the nose cone 116 to the outer housing 110. The latches 176 are spaced apart at different angular positions around a perimeter of the nose cone 116. The latches 176 are configured to engage the locking tabs 142 on the outer contact 120 to secure the nose cone 116 to the outer housing 110. In an embodiment, each of the latches 176 engages a corresponding one of the locking tabs 142. The locking tab 142 of the multiple locking tabs 142 that a first of the latches 176 engages depends on a rotational orientation of the nose cone 116 relative to the outer housing 110. Thus, the each latch 176 may engage a different locking tab 142 for each different rotational orientation of the nose cone 116. The orientation of the keying ribs 118 relative to the outer housing 110 is different for each different rotational orientation. The different orientations of the keying ribs 118 affect the required orientation of the mating connector as the mating connector is mated with the header assembly 100.

The optional shield member 104 is configured to be coupled to the outer housing 110 such that the shield member 104 provides shielding for the opening in the casing of the device. The shield member 104 may form an electrically conductive path between a grounded electronic component, such as the casing of an electronic device, and the outer housing 110. The shield member 104 may also form an electrically conductive path between the casing and the circuit board 102. The shield member 104 is configured to be coupled to the outer housing 110 generally between the rear shell 122 and the nose cone 116. The nose cone 116 may hold the shield member 104 on the outer housing 110. The nose cone 116 may press the shield member 104 against the rear shell 122 to ensure electrical contact between the shield member 104 and the outer housing 110. The shield member 104 is coupled to the outer contact 120 such that the shield member 104 is electrically and mechanically connected to the outer contact 120.

The shield member 104 is formed of a conductive material, such as a metal material. The shield member 104 may be manufactured by a stamping and forming process. The shield member 104 includes a plate 180 having an opening 182 therethrough with spring contacts 184 extending into the opening 182. The spring contacts 184 engage the outer contact 120 to mechanically and electrically connect the shield member 104 to the outer contact 120. A plurality of spring fingers 186 extend from the plate 180. The spring fingers 186 are configured to be spring biased against the grounded electronic component, such as the casing, when the header assembly 100 is coupled to the grounded electronic component.

Figure 3:
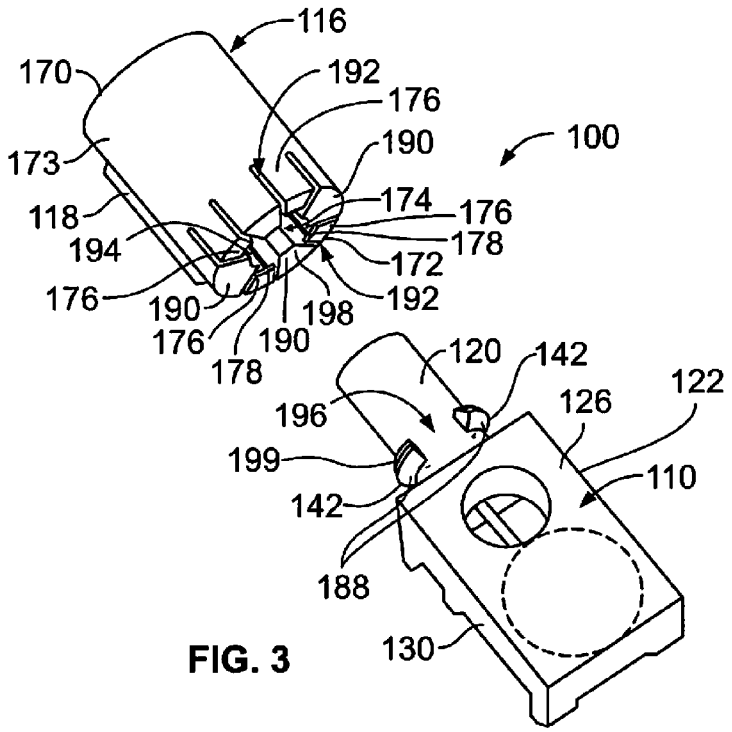
FIG. 3 is a top perspective view of the header assembly showing a nose cone poised for coupling to an outer housing.

FIG. 3 is a top perspective view of the header assembly 100 showing the nose cone 116 poised for coupling to the outer housing 110. At the rear 172 of the nose cone 116, the nose cone 116 includes the multiple latches 176 spaced apart at different angular positions around a perimeter of the nose cone 116. The latches 176 generally extend rearward. In an embodiment, sides of the latches 176 are defined by slits 192 that extend through the nose cone 116 between the exterior surface 173 and an interior surface 194 that defines the cavity 174. The slits 192 allow the latches 176 to deflect radially outward relative to other portions of the nose cone 116. The latches 176 include hook portions 178 at the rear 172. The hook portions 178 extend into the cavity 174 of the nose cone 116. The hook portions 178 are configured to engage back surfaces 188 of the locking tabs 142 to secure the nose cone 116 to the outer housing 110.

The nose cone 116 includes alignment lugs 190 at the rear 172. The alignment lugs 190 extend into the cavity 174 from the interior surface 194 of the nose cone 116. The alignment lugs 190 are spaced apart from one another at different angular positions around the perimeter of the nose cone 116. The alignment lugs 190 are received in spaces 196 defined between the locking tabs 142 of the outer contact 120 when the nose cone 116 is coupled to the outer housing 110. In an embodiment, the alignment lugs 190 alternate with the latches 176 along a circumference of the nose cone 116. For example, each alignment lug 190 is positioned or disposed circumferentially between two adjacent latches 176, and each latch 176 is disposed between two adjacent alignment lugs 190. In the illustrated embodiment, the nose cone 116 includes four latches 176 that alternate with four alignment lugs 190 at the rear 172. In an alternative embodiment, the nose cone 116 has an amount other than four alignment lugs 190, such as one, two, three, five, or six. In another alternative embodiment, the nose cone 116 has an amount other than four latches 176, such as one, two, three, five, or six.

The alignment lugs 190 extend from the rear 172 longitudinally along an axis of the nose cone 116 towards the front 170. In an embodiment, the alignment lugs 190 extend less than half of the length of the nose cone 116 to provide room in the cavity 174 at the front 170 for receiving the mating connector. For example, the alignment lugs 190 may extend a length that is less than the length of the slits 192. Alternatively, the alignment lugs 190 may extend equal to or farther towards the front 170 than the length of the slits 192.

The alignment lugs 190 are used to orient the nose cone 116 relative to the outer housing 110 in one of multiple distinct rotational orientations. For example, in one rotational orientation, one of the keying ribs 118 may be disposed proximate to (for example, extend outward from the exterior surface 173 in a direction pointing towards) the top wall 126 of the rear shell 122, and in a second rotational orientation, the keying rib 118 may be disposed proximate to one of the side walls 130. The alignment lugs 190 are keyed with the locking tabs 142 of the outer contact 120. For example, the alignment lugs 190 fit in the spaces 196 between the locking tabs 142 when the nose cone 116 is oriented relative to the outer housing 110 in one of the distinct rotational orientations. As the nose cone 116 is loaded onto the outer contact 120, such that the outer contact 120 is received in the cavity 174 through the rear 172 of the nose cone 116, the alignment lugs 190 are received in the spaces 196 and do not obstruct the coupling between the latches 176 and the locking tabs 142. However, the alignment lugs 190 are also configured to block the nose cone 116 from coupling to the outer contact 120 if the nose cone 116 is oriented relative to the outer housing 110 in a rotational orientation other than one of the specified distinct rotational orientations. In such case, rear walls 198 of the alignment lugs 190 engage front surfaces 199 of the locking tabs 142 as the nose cone 116 is loaded onto the outer contact 120, which mechanically blocks further movement of the nose cone 116 towards the rear shell 122. The latches 176 are not able to couple to the locking tabs 142 when the alignment lugs 190 stub on the front surfaces 199 of the locking tabs 142. Thus, the alignment lugs 190 prevent the nose cone 116 from coupling to the outer contact 120 in rotational orientations other than the specified distinct rotational orientations.

Figure 4:
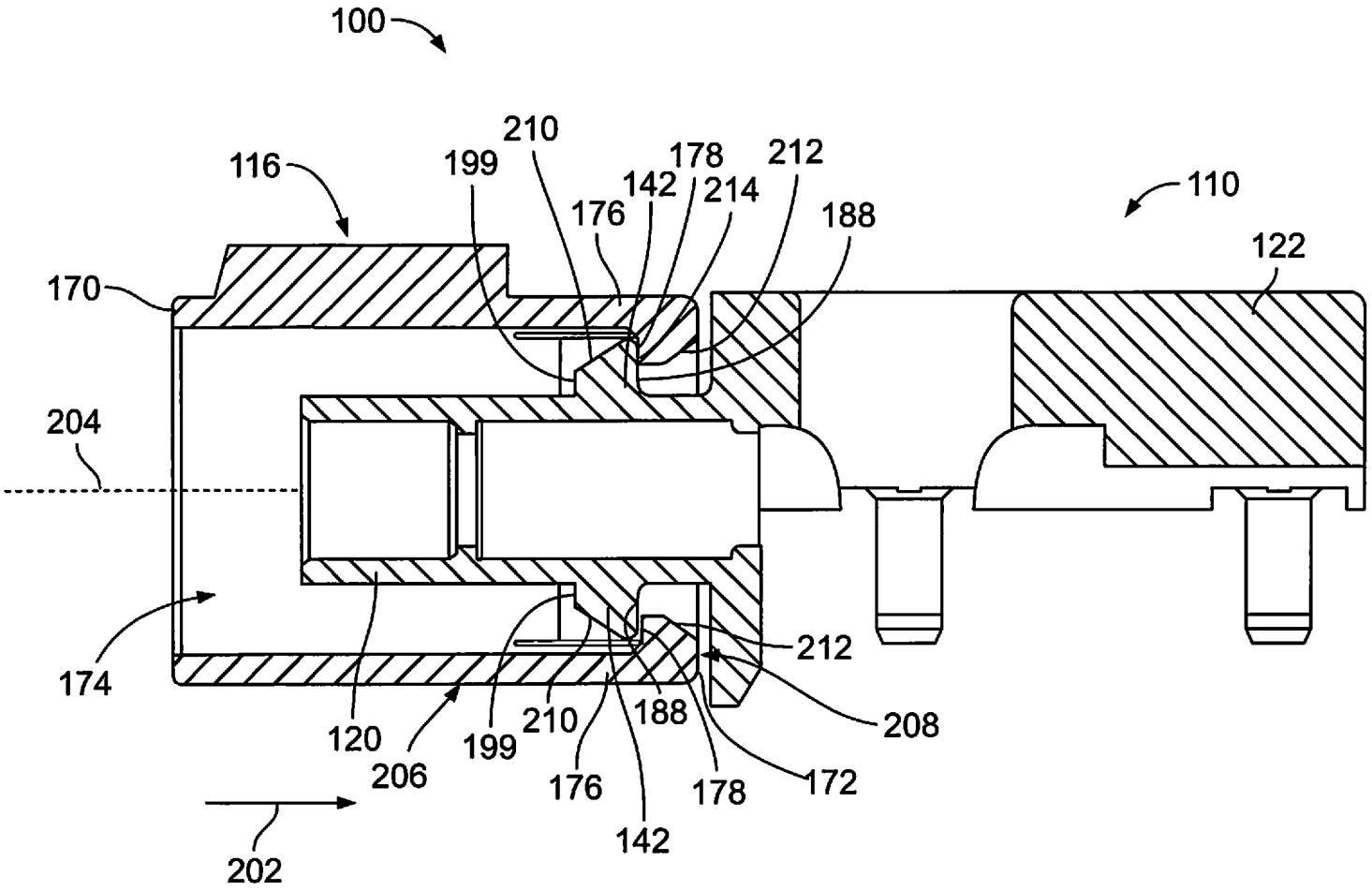
FIG. 4 is a side cross sectional view of the header assembly showing the nose cone coupled to the outer housing.

FIG. 4 is a side cross sectional view of the header assembly 100 showing the nose cone 116 coupled to the outer housing 110. To couple the nose cone 116 to the outer housing 110, the nose cone 116 is loaded over the outer contact 120 toward the rear shell 122 in a loading direction 202 until the latches 176 engage the corresponding locking tabs 142. The hook portions 178 of the latches 176 are captured behind the back surfaces 188 of the locking tabs 142 to secure the nose cone 116 to the outer housing 110. The back surfaces 188 act as catch surfaces. The latches 176 may be released by lifting or prying the latches 176 over the back surfaces 188 to remove the nose cone 116.

The nose cone 116 extends along a longitudinal axis 204 between the front 170 and the rear 172. The latches 176 may extend generally parallel to the longitudinal axis when the latches 176 are in un-biased or natural resting positions. In an embodiment, the latches 176 are cantilevered and have a fixed end 206 and a free end 208. The fixed end 206 is directly connected to the body of the nose cone 116, while the free end 208 is indirectly connected to the nose cone 116 via the fixed end 206. The free end 208 is located more proximate to the rear 172 of the nose cone 116 than the fixed end 206. The hook portions 178 of the latches 176 are located at or proximate to the free ends 208. The free end 208 of each latch 176 is resiliently deflectable along an arc from the natural resting position of the latch 176 in a direction radially outward away from the cavity 174. The resilience of the latches 176 (i.e., the bias of the free end 208 of the latches 176 to the natural resting positions thereof) generates a force that causes the hook portions 178 of the latches 176 to snap radially inward towards the cavity 174 when the hook portions 178 clear the back surfaces 188 of the locking tabs 142.

In an embodiment, the locking tabs 142 each include a ramp 210 that extends at least partially between the front surfaces 199 and the back surfaces 188. Optionally, the ramps 210 may be the front surfaces 199 such that the locking tabs 142 have a triangular front section. The ramps 210 are sloped radially outward in a direction towards the rear shell 122. In an embodiment, the latches 176 also include ramps 212 that complement the ramps 210 of the locking tabs 142. The ramps 212 are located at the free ends 208 and slope radially outward away from the cavity 174. For example, the ramps 212 may extend along the hook portions 178 longitudinally between a hook surface 214 and the free end 208. Upon loading the nose cone 116 onto the outer housing 110, the ramps 212 of the latches 176 engage the corresponding ramps 210 of the locking tabs 142, which cause the latches 176 to deflect outward around the locking tabs 142 without stubbing.

Figure 5:
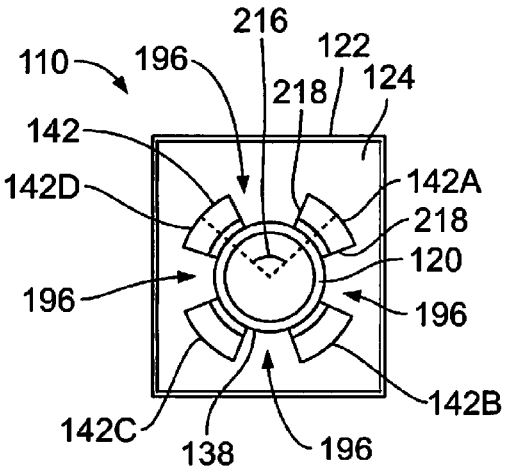
FIG. 5 is a front view of the outer housing.

FIG. 5 is a front view of the outer housing 110. The outer contact 120 extends forward from the front wall 124 of the rear shell 122. The locking tabs 142 extend outward from the outer contact 120. In an embodiment, the locking tabs 142 are equally spaced around the perimeter of the outer contact 120. For example, in the illustrated embodiment the outer housing 110 includes four locking tabs 142, and the locking tabs 142 are located at different angular positions that are 90 degrees from one another around the outer contact 120. Thus, the angle 216 between adjacent locking tabs 142 is 90 degrees. A first locking tab 142A extends from the outer contact 120 in an opposite direction from a third locking tab 142C, and a second locking tab 142B extends in an opposite direction from a fourth locking tab 142D. As used herein, the terms "first," "second," etc., used in conjunction with the locking tabs 142, the latches 176, and/or the alignment lugs 190 are used merely for differentiation. The four locking tabs 142A-D define four spaces 196 between each adjacent locking tab 142. Each space 196 is configured to receive an alignment lug 190 (shown in FIG. 3) of the nose cone 116 (FIG. 3). Thus, since the same lug 190 may be received in any of the four spaces 196 depending on the rotational orientation of the nose cone 116 relative to the outer housing 110, the nose cone 116 may be coupled to the outer housing 110 in four different distinct rotational orientations. The rotational orientations are orthogonal to each other. In an alternative embodiment, the outer contact 120 has other than four locking tabs 142, such as two, three, or five. For example, with three locking tabs 142, the outer contact 120 defines three spaces 196 which could allow for three distinct rotational orientations of the nose cone 116 relative to the outer housing 110. In alternative embodiments, the locking tabs 142 may have angular positions that are not 90 degrees from one another. For example, the three locking tabs 142 mentioned above may be equally spaced at angular positions that are 120 degrees from one other. In another example, the locking tabs 142 need not be equally spaced around the outer contact 120. For example, an outer contact 120 having four locking tabs 142 may have some spaces between two locking tabs 142 that are more than 90 degrees and other spaces between two of the locking tabs 142 that are less than 90 degrees.

The locking tabs 142 may have quadrilateral cross-sections when viewed from the front. For example, the locking tabs 142 may have radially extending sides 218 such that the locking tabs 142 have increasing width with radial distance from the exterior surface 138 of the outer contact 120, resembling trapezoids. The locking tabs 142 may have other shapes in other embodiments. In the illustrated embodiment, the four locking tabs 142A-D are identical to one another in size and shape, such that any of the locking tabs 142A-D may be used to engage a specific one of the latches 176 (shown in FIG. 4) of the nose cone 116 (FIG. 4).

Figure 6:
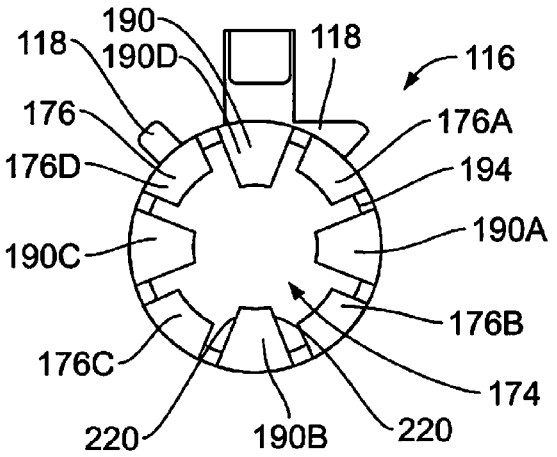
FIG. 6 is a rear view of the nose cone.

With continued reference to FIG. 5, FIG. 6 is a rear view of the nose cone 116. In an embodiment, the nose cone 116 is cylindrical, and the latches 176 are equally spaced around the circumference of the nose cone 116. The alignment lugs 190 may also be equally spaced around the circumference of the nose cone 116. The nose cone 116 is configured to be coupled to the outer contact 120. The nose cone 116 includes four latches 176A-D, each configured to engage one of the locking tabs 142A-D. The nose cone 116 also includes four alignment lugs 190A-D, each configured to be received in one of the spaces 196 between the locking tabs 142A-D. In other embodiments, the nose cone 116 may have other than four latches 176 and/or other than four alignment lugs 190, such as one, two, three, or five of either the latches 176 or the lugs 190.

In an embodiment, the alignment lugs 190 are used for anti-rotation when the nose cone 116 is coupled to the outer contact 120. The shapes of the alignment lugs 190 complement the spaces 196 between the locking tabs 142. For example, the alignment lugs 190 have side walls 220 that extend radially inward from the interior surface 194 of the nose cone 116 into the cavity 174. The alignment lugs 190 may have trapezoidal shapes when viewed from the rear, such that the lateral (or circumferential) width of the lugs 190 decreases with increased distance away from the interior surface 194. In an embodiment, the side walls 220 of the alignment lugs 190 are configured to engage the sides 218 of the locking tabs 142 when the nose cone 116 is coupled to the outer contact 120 to restrict rotation of the nose cone 116 relative to the outer housing 110. For example, the alignment lug 190 in one of the spaces 196 between two adjacent locking tabs 142 is configured to restrict rotation of the nose cone 116 by abutting against the side 218 of one or both of the adjacent locking tabs 142 that define the space 196. Thus, by restricting rotation, the alignment lugs 190 hold the rotational orientation of the nose cone 116 relative to the outer housing 110 in one of the distinct, pre-defined orientations.

The nose cone 116 is variably positionable on the outer contact 120 in multiple distinct rotational orientations. The angular position of the keying ribs 118 relative to the outer housing 110 is different depending on which of the rotational orientations the nose cone 116 is in. In the illustrated embodiment, the nose cone 116 is selectively positionable in one of four distinct rotational orientations relative to the outer housing 110. The first latch 176A of the latches 176 engages a different one of the locking tabs 142A-D in each of the four rotational orientations. Still, in each rotational orientation, each of the latches 176A-D engages one of the locking tabs 142A-D to secure the nose cone 116 to the outer contact 120. In alternative embodiments, the nose cone 116 is variably positionable on the outer contact 120 in other than four different rotational orientations, due to varying numbers of locking tabs 142 (and spaces 196 therebetween), latches 176, and/or alignment lugs 190. For example, in one alternative embodiment, the nose cone 116 may be variably positionable in one of three different rotational orientations, while in another embodiment, the nose cone 116 may be positionable in five or more rotational orientations. Having multiple mating orientations for the nose cone 116 on the outer housing 110 provides different keying configurations for the header assembly 100 using the same outer housing 110 with the same nose cone 116.

Figure 7A:
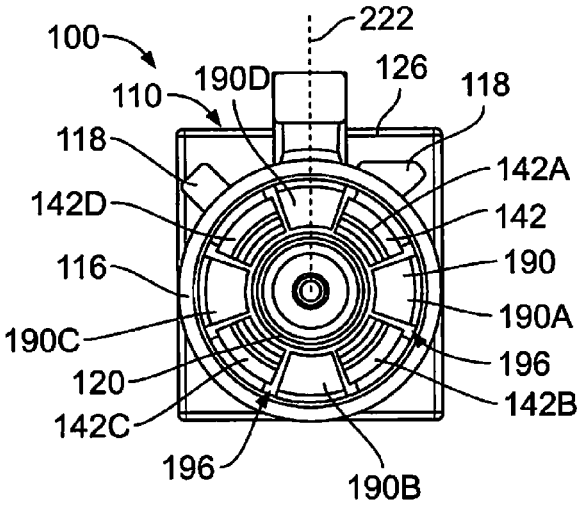
FIGS. 7A-7D show the nose cone at different rotational orientations relative to the outer housing.
Figure 7B:
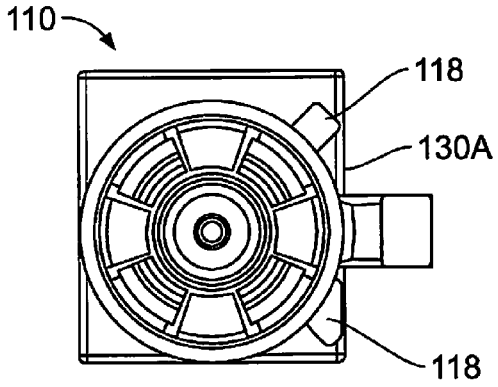
Figure 7C:
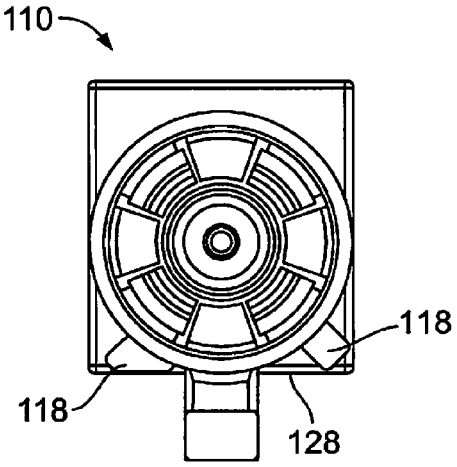
Figure 7D:
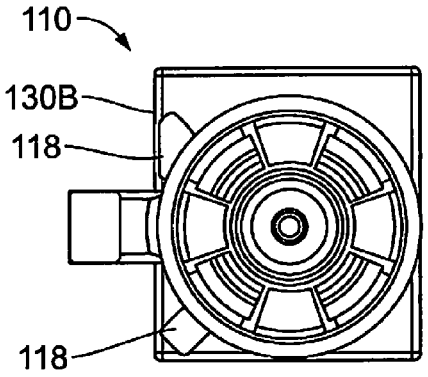

FIGS. 7A-7D show the nose cone 116 at different rotational orientations relative to the outer housing 110. FIGS. 7A-7D show the nose cone 116 shown and described in FIG. 6 coupled to the outer housing 110 shown and described in FIG. 5 in each of the four distinct rotational orientations. As shown in FIGS. 7A-7D, the angular positions of the keying ribs 118 of the nose cone 116 relative to the top wall 126 of the outer housing 110, for example, differ for each of the different rotational orientations. FIG. 7A shows the nose cone 116 in a first of the orientations relative to the outer housing 110; FIG. 7B shows the nose cone 116 in a second orientation; FIG. 7C shows the nose cone 116 in a third orientation; and FIG. 7D shows the nose cone 116 in a fourth orientation. The outer housing 110 is oriented the same way in each of FIGS. 7A-7D.

In an embodiment, the four distinct rotational orientations are orthogonal to each other. For example, in the first orientation shown in FIG. 7A, the keying ribs 118 are angularly positioned proximate to the top wall 126 of the outer housing 110. In the second orientation shown in FIG. 7B, the keying ribs 118 are angularly positioned proximate to a right side wall 130A of the side walls 130 of the outer housing 110. The keying ribs 118 are proximate to the bottom 128 of the outer housing 110 in the third orientation shown in FIG. 7C. Finally, the keying ribs 118 are proximate to a left side wall 130B of the side walls 130 of the outer housing 110 in the fourth orientation shown in FIG. 7D. Thus, the keying ribs 118 are located at four different angular positions depending on the rotational orientation of the nose cone 116, which provides multiple different keying configurations.

The multiple different keying configurations allow the header assembly 100 to accommodate four different orientations of the mating connector relative to the header assembly 100 using only one nose cone 116 and one outer housing 110. For example, a product family may include the outer housing 110, the illustrated nose cone 116, and at least one other nose cone that has different keying features than the keying ribs 118 shown, where the nose cones are substitutable on the outer housing 110. Such a product family that includes five total nose cones and the one outer housing 110 could be arranged to achieve twenty distinct keying configurations using only the six different housing parts (not including the center contact and the dielectric body) because each of the five nose cones can be rotated in four different rotational orientations relative to the outer housing 110. Manufacture of the six parts is less expensive than manufacturing twenty discrete parts. For example, tooling cost may be reduced when manufacturing less part numbers. Additionally, the product family includes only one die cast part, namely the outer housing 110, with five plastic injection molded nose cones. Tooling and manufacturing cost of the product family is greatly reduced with one die cast part and five plastic injection molded parts, as compared to a product family having twenty discrete die cast components to achieve the twenty keying configurations. The nose cones may be formed using a single mold with different interchangeable tooling to change the location of the keying ribs.

In the illustrated embodiment in FIGS. 7A-7D, the four locking tabs 142A-D have angular positions generally at 45 degrees, 135 degrees, 225 degrees, and 315 degrees, respectively, relative to a reference axis 222 that extends vertically from a radial center of the outer contact 120. The four alignment lugs 190A-D are received in the spaces 196 between the locking tabs 142. The alignment lugs 190A-D have angular positions generally at 90 degrees, 180 degrees, 270 degrees, and 360 degrees, respectively, relative to the reference axis 222 when the nose cone 116 is coupled to the outer contact 120. In an alternative embodiment, the locking tabs 142A-D have angular positions generally at 90 degrees, 180 degrees, 270 degrees, and 360 degrees, respectively, relative to the reference axis 222, and the alignment lugs 190A-D have angular positions generally at 45 degrees, 135 degrees, 225 degrees, and 315 degrees, respectively. It is recognized that the locking tabs 142 and the alignment lugs 190 need not be at any specific angle relative to the axis 222. In addition, in alternative embodiments, the locking tabs 142 and/or the alignment lugs 190 may be separated from other locking tabs 142 or alignment lugs 190, respectively, by angles other than 90 degrees, and the angles need not be consistent around a perimeter of the outer contact 120 or the nose cone 116, respectively.

Figure 8:
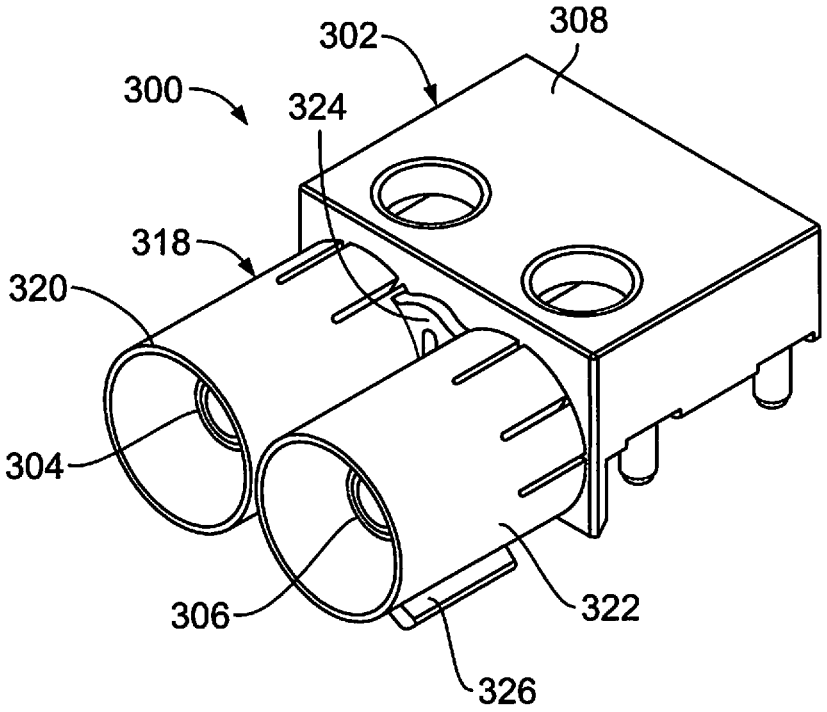
FIG. 8 is a front perspective view of a header assembly according to an alternative embodiment.
Figure 9:
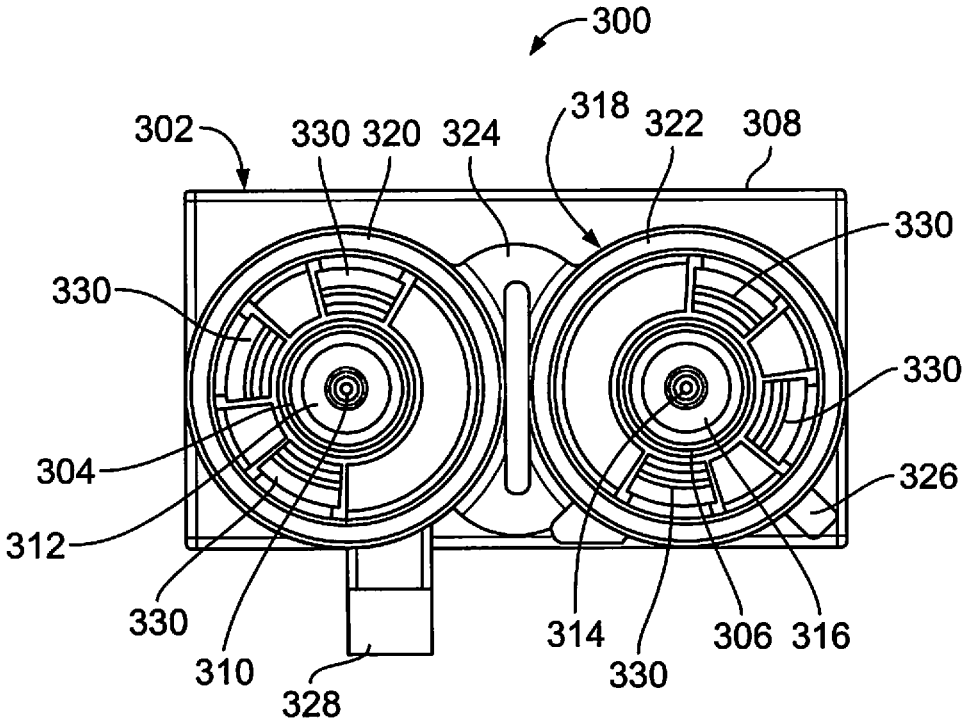
FIG. 9 is a front view of the header assembly shown in FIG. 8.

FIG. 8 is a front perspective view of a header assembly 300 according to an alternative embodiment. FIG. 9 is a front view of the header assembly 300 shown in FIG. 8. According to the embodiment shown in FIGS. 8 and 9, the outer housing 302 includes a first outer contact 304 and a second outer contact 306 extending forward from the rear shell 308. The first outer contact 304 surrounds a first center contact 310 and a first dielectric body 312. The second outer contact 306 surrounds a second center contact 314 and a second dielectric body 316. The outer housing 302 is coupled to a cone set 318. The cone set 318 includes a first nose cone 320 and a second nose cone 322. The first nose cone 320 is coupled to and surrounds the first outer contact 304, while the second nose cone 322 is coupled to and surrounds the second outer contact 306. The first nose cone 320 is integrally connected to the second nose cone 322. For example, the cone set 318 may be formed as an integral, one-piece body having both nose cones 320, 322. The nose cones 320, 322 are connected via a bridge member 324. Optionally, one or both of the nose cones 320 include one or more keying ribs 326 and primary latch catches 328 for mating with a mating connector.

Optionally, as shown in FIG. 9, each of the outer contacts 304, 306 includes three locking tabs 330. Other numbers of locking tabs may be used in other embodiments, since the cone set 318 is only positionable relative to the outer housing 302 in two different rotational orientations, due to the dual cone structure. For example, in the orientation shown in FIG. 9, the primary latch catch 328 extends downwards below the first outer contact 304. But, the cone set 318 may be flipped or inverted 180 degrees such that the primary latch catch 328 extends upward above the second outer contact 306 in a second orientation of the cone set 318 relative to the outer housing 302.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A header assembly comprising:

a center contact;

a dielectric body surrounding the center contact;

an outer housing holding the center contact and the dielectric body, the outer housing having a rear shell and an outer contact extending forward from the rear shell, the outer contact receiving the center contact and the dielectric body, the outer contact having multiple locking tabs extending from an exterior thereof, the locking tabs spaced apart at different angular positions around a perimeter of the outer contact, the locking tabs each including two sides and a back surface extending between the two sides, the back surface facing towards the rear shell; and a nose cone coupled to and surrounding the outer contact, the nose cone defining a cavity that receives the outer contact therein, the nose cone having one or more keying ribs along an exterior thereof, the nose cone having multiple latches spaced apart at different angular positions around a perimeter of the nose cone, the latches engaging the back surfaces of the corresponding locking tabs to secure the nose cone to the outer housing in one of at least two distinct rotational orientations, the nose cone further including multiple alignment lugs that extend into the cavity and are received in spaces defined between adjacent locking tabs of the outer contact, the alignment lugs configured to engage the sides of the locking tabs to block rotation of the nose cone relative to the outer contact.

2. The header assembly of claim 1, wherein the locking tabs are equally spaced around the perimeter of the outer contact.

3. The header assembly of claim 1, wherein the nose cone is variably positionable on the outer contact in at least three distinct rotational orientations, an angular position of the one or more keying ribs relative to the outer housing being different depending on which of the distinct rotational orientations the nose cone is in.

4. The header assembly of claim 3, wherein a first latch of the multiple latches engages a different locking tab of the multiple locking tabs in each of the distinct rotational orientations of the nose cone relative to the outer contact.

5. The header assembly of claim 1, wherein the alignment lugs of the nose cone alternate with the latches along a circumference of the nose cone such that each alignment lug is disposed circumferentially between two adjacent latches.

6. The header assembly of claim 1, wherein the multiple locking tabs comprise a first locking tab and a second locking tab, the first and second locking tabs located at angular positions that are less than 180 degrees from one another around the outer contact.

7. The header assembly of claim 1, wherein the multiple latches comprise a first latch and a second latch, the first and second latches located at angular positions that are less than 180 degrees from one another around the nose cone.

8. The header assembly of claim 1, wherein the nose cone extends along a longitudinal axis between a front and a rear, the front defining a mating interface for accommodating a mating connector, the multiple latches extending generally parallel to the longitudinal axis between a fixed end and a free end, the free end located more proximate to the rear of the nose cone than the fixed end, the free ends of the latches including hooks that engage the back surfaces of the locking tabs to secure the nose cone to the outer housing.

9. The header assembly of claim 1, wherein the outer contact, the dielectric body, and the center contact are a first outer contact, a first dielectric body, and a first center contact, respectively, the outer housing further including a second outer contact extending forward from the rear shell, the second outer contact receiving a second dielectric body and a second center contact, wherein the nose cone is a first nose cone that is integrally connected to a second nose cone in a cone set, the first nose cone coupled to and surrounding the first outer contact, the second nose cone coupled to and surrounding the second outer contact.

10. A header assembly comprising:

a center contact;

a dielectric body surrounding the center contact;

an outer housing holding the center contact and the dielectric body, the outer housing having a rear shell and an outer contact extending forward from the rear shell, the outer contact receiving the center contact and the dielectric body, the outer contact having multiple locking tabs extending from an exterior thereof, the locking tabs located at different angular positions around a perimeter of the outer contact; and a nose cone coupled to the outer contact and extending along a longitudinal axis between a front and an opposite rear, the nose cone defining a cavity that receives the outer contact therein, the rear of the nose cone facing the rear shell, the nose cone having one or more keying ribs along an exterior thereof, the nose cone having a body and multiple latches extending from the body at different angular positions around a perimeter of the nose cone, the latches each extending generally parallel to the longitudinal axis between a fixed end directly attached to the body and a free end indirectly attached to the body via the fixed end, the latches including hooks at least proximate to the free ends, the hook of each of the latches engaging one of the locking tabs to secure the nose cone to the outer housing in one of multiple distinct orthogonal rotational orientations.

11. The header assembly of claim 10, wherein the outer contact has four locking tabs that have angular positions generally at 45 degrees, 135 degrees, 225 degrees, and 315 degrees, respectively, relative to a reference axis.

12. The header assembly of claim 11, wherein the nose cone includes four alignment lugs extending into the cavity from an interior surface of the nose cone, the alignment lugs being received in spaces defined between the locking tabs when the nose cone is coupled to the outer contact, the alignment lugs having angular positions generally at 90 degrees, 180 degrees, 270 degrees, and 360 degrees, respectively, relative to the reference axis when coupled to the outer contact.

13. The header assembly of claim 10, wherein the outer contact has four locking tabs that have angular positions generally at 90 degrees, 180 degrees, 270 degrees, and 360 degrees, respectively, relative to a reference axis.

14. The header assembly of claim 13, wherein the nose cone includes four alignment lugs extending into the cavity from an interior surface of the nose cone, the alignment lugs being received in spaces defined between the locking tabs when the nose cone is coupled to the outer contact, the alignment lugs having angular positions generally at 45 degrees, 135 degrees, 225 degrees, and 315 degrees, respectively, relative to the reference axis when coupled to the outer contact.

15. The header assembly of claim 10, wherein the nose cone includes alignment lugs extending into the cavity and received in spaces defined between the locking tabs of the outer contact, the alignment lugs keyed with the locking tabs such that rear walls of the alignment lugs are configured to engage front surfaces of the locking tabs to mechanically block the nose cone from coupling to the outer contact in rotational orientations other than the distinct orthogonal rotational orientations.

16. The header assembly of claim 10, wherein, as the nose cone is loaded onto the outer contact, the locking tabs of the outer contact are configured to engage and deflect the free ends of the corresponding latches radially outward about the fixed ends of the latches until the hooks of the latches clear the locking tabs.

17. The header assembly of claim 10, wherein the free ends of the latches of the nose cone are disposed more proximate to the rear of the nose cone than a proximity of the fixed ends of the latches to the rear of the nose cone.

18. A header assembly comprising:

a center contact;

a dielectric body surrounding the center contact;

an outer housing holding the center contact and the dielectric body, the outer housing having a rear shell and an outer contact extending forward from the rear shell, the outer contact receiving the center contact and the dielectric body, the outer contact having multiple locking tabs extending from an exterior thereof, the locking tabs spaced apart at different angular positions around a perimeter of the outer contact, the locking tabs each including two sides and a back surface extending between the two sides and facing towards the rear shell, the locking tabs defining spaces between corresponding sides of adjacent locking tabs; and a nose cone coupled to the outer contact, the nose cone defining a cavity that receives the outer contact therein, the nose cone having one or more keying ribs along an exterior thereof, the nose cone further having multiple latches spaced apart at different angular positions around a perimeter of the nose cone, the latches cantilevered to a body of the nose cone and each extending between a fixed end directly attached to the body and a free end indirectly attached to the body via the fixed end, the latches having hooks at least proximate to the free ends that engage the back surfaces of the locking tabs to couple the nose cone to the outer contact, the nose cone including alignment lugs extending into the cavity and received in the spaces between the locking tabs of the outer contact to orient the nose cone relative to the outer housing in one of multiple distinct rotational orientations, the alignment lugs configured to engage the sides of the locking tabs to block rotation of the nose cone relative to the outer contact.

19. The header assembly of claim 18, wherein the alignment lugs of the nose cone are spaced apart from one another, the alignment lugs each being disposed circumferentially between two adjacent latches of the nose cone such that the alignment lugs alternate with the latches along a circumference of the nose cone.

20. The header assembly of claim 18, wherein a shape of the alignment lugs complements the spaces between the locking tabs, rear walls of the alignment lugs being configured to engage front surfaces of the locking tabs to mechanically block the nose cone from coupling to the outer contact when the nose cone is in a rotational orientation that is not one of the distinct rotational orientations.

* * * * *